US007661341B2

(12) United States Patent
Hsu

(10) Patent No.: US 7,661,341 B2
(45) Date of Patent: Feb. 16, 2010

(54) WRENCH WITH ELECTRONIC TORQUE DISPLAY UNIT

(76) Inventor: Chin-Ho Hsu, 6F-1, No. 192, Sec. 3, Da Tong Rd., Xi Zhi Chen, Taipei Hsien (TW)

( * ) Notice: Subject to any disclaimer, the term of this patent is extended or adjusted under 35 U.S.C. 154(b) by 117 days.

(21) Appl. No.: 12/109,751

(22) Filed: Apr. 25, 2008

(65) Prior Publication Data

US 2009/0266206 A1 Oct. 29, 2009

(51) Int. Cl.
*B25B 23/155* (2006.01)

(52) U.S. Cl. ..... 81/478; 73/862.23

(58) Field of Classification Search ..... 81/467, 81/478–483; 73/862.21, 862.22, 862.23
See application file for complete search history.

(56) References Cited

U.S. PATENT DOCUMENTS 3,666,021 A * 5/1972 Whitehouse ..... 173/180
3,895,517 A * 7/1975 Otto ..... 73/769
4,125,016 A * 11/1978 Lehoczky et al. ..... 73/862.23
4,620,449 A * 11/1986 Borries et al. ..... 73/862.21
5,537,877 A * 7/1996 Hsu ..... 73/862.23
6,948,380 B1 * 9/2005 Shiao et al. ..... 73/862.21
7,000,508 B2 * 2/2006 Li et al. ..... 81/479
7,047,849 B2 * 5/2006 Lai ..... 81/479

* cited by examiner

*Primary Examiner*—D. S Meislin
(74) *Attorney, Agent, or Firm*—Rosenberg, Klein & Lee

(57) ABSTRACT

A wrench with electronic torque display unit includes a torque adjustment mechanism which includes a sleeve, two gears, a rod and a movable tube, and a locking mechanism which includes a positioning cap, wherein the value of the torque to be output can be set by operating the adjustment mechanism by rotating the positioning cap. The pre-set value is displayed on the display screen so as to provide a wrench with convenient operation and precise feature.

4 Claims, 8 Drawing Sheets

WRENCH WITH ELECTRONIC TORQUE DISPLAY UNIT

FIELD OF THE INVENTION

The present invention relates to a wrench with an electronic torque display unit which adjusts variable resistors by the revolutions of a small gear and a circuit board to detect the resistance so display in the electronic torque display unit.

BACKGROUND OF THE INVENTION

A conventional wrench with an electronic torque display unit is disclosed in U.S. Pat. No. 5,537,877 and shown in FIGS. 7 and 8, wherein the wrench with a case A, a driving unit B, a knocking member C, a push unit D which is located in the case A and in contact with the knocking member C in axial direction such that the knocking member C does not knock the case A before the pre-set torque is reached. An adjustment unit can adjust the initial force of the push unit D to set the value of the pre-set torque.

The push unit D includes a push member D2 which is movable axially in the case A, a spring D1 located between the push member D2 and the knocking member C, a tubular handle F and a rod unit E. The handle F has a connection end rotatably connected with a second end of the case A and the rod unit has a first end inserted into the handle F and a second end of the rod unit E is inserted into the casa A and is connected with the push member D2. The first and second ends of the rod unit E are operated by the handle F and the case A. The push member D2 is moved axially by rotating the handle F.

The torque unit further includes a torque detection unit G which includes bodies G1, G2, a detection member G3, a transferring circuit G4 electrically connected with the detection member G3, and a display unit G5. The bodies G1, G2 are connected to the case A and the detection unit G is connected with the bodies G1, G2. The detection unit G generates a signal which is a signal regarding to the push member D2. The transferring circuit G4 transfers the electronic signals into digital signals which are shown in the display unit G5.

The present invention intends to provide a wrench with an electronic torque display unit which improves shortcomings such as inconvenience of use and less precise of the conventional torque display unit for wrenches.

SUMMARY OF THE INVENTION

The present invention relates to a wrench comprising:

a shank having a driving head connected to a first end of the shank and a ratchet member received in a recess defined in the driving head, two pawls pivotally engaged with the ratchet member and a switch lever connected with the pawls, a cover disposed on the driving head and closing the recess;

a case fixedly connected to the shank and having a first end into which the shank is inserted and a second end which includes a first slot defined axially through a wall thereof;

an electronic display unit connected to the case and including a first part and a second part, the first part having a circuit board and a display screen;

a sleeve being a hollow member and having a first end thereof fixed to the second end of the case, a second end of the sleeve pivotally connected to a handle, the handle including a stepped hole defined in an open end thereof and a plurality of notches defined in the second end of the sleeve, variable resistors provided in the second end of the sleeve;

a torque unit received in the case and the sleeve, the torque unit including a knocking member, a spring, a movable tube, a rod, a first gear, a second gear which has less number of teeth than that of the first gear, and a disk, the movable tube having first inner threads defined therein and a guide pin extending through the first slot in the case and guiding movement of the movable tube, the rod having a first end and a second end, the first end of the rod including first outer threads which are threadedly engaged with the first inner threads in the movable tube, the first gear fixed to the rod and the second gear engaged with the first gear and engaged with the variable resistors, the disk including engaging pins corresponding in position to the notches in the sleeve, and a pin extending through the handle and the rod.

The first gear drives the second gear which is connected with the variable resistors, and the variable resistors are electrically connected with the electronic display unit.

The wrench further comprises a positioning arrangement which includes second outer threads formed on the second end of the rod, a push member, the first gear and a collar fitted onto the rod and a positioning cap threadedly connected to the second outer threads with second inner threads defined in the positioning cap, the push member including dimples and a plurality of positioning pins connected to the first gear, the positioning pins being removably engaged with the dimples, the collar including a second slot.

The primary object of the present invention is to provide an electronic torque display unit which shows the pre-set value of torque on the screen and generates sound when the wrench reaches the pre-set torque. The wrench is easily operated and the value of torque is easily to read from the display screen.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
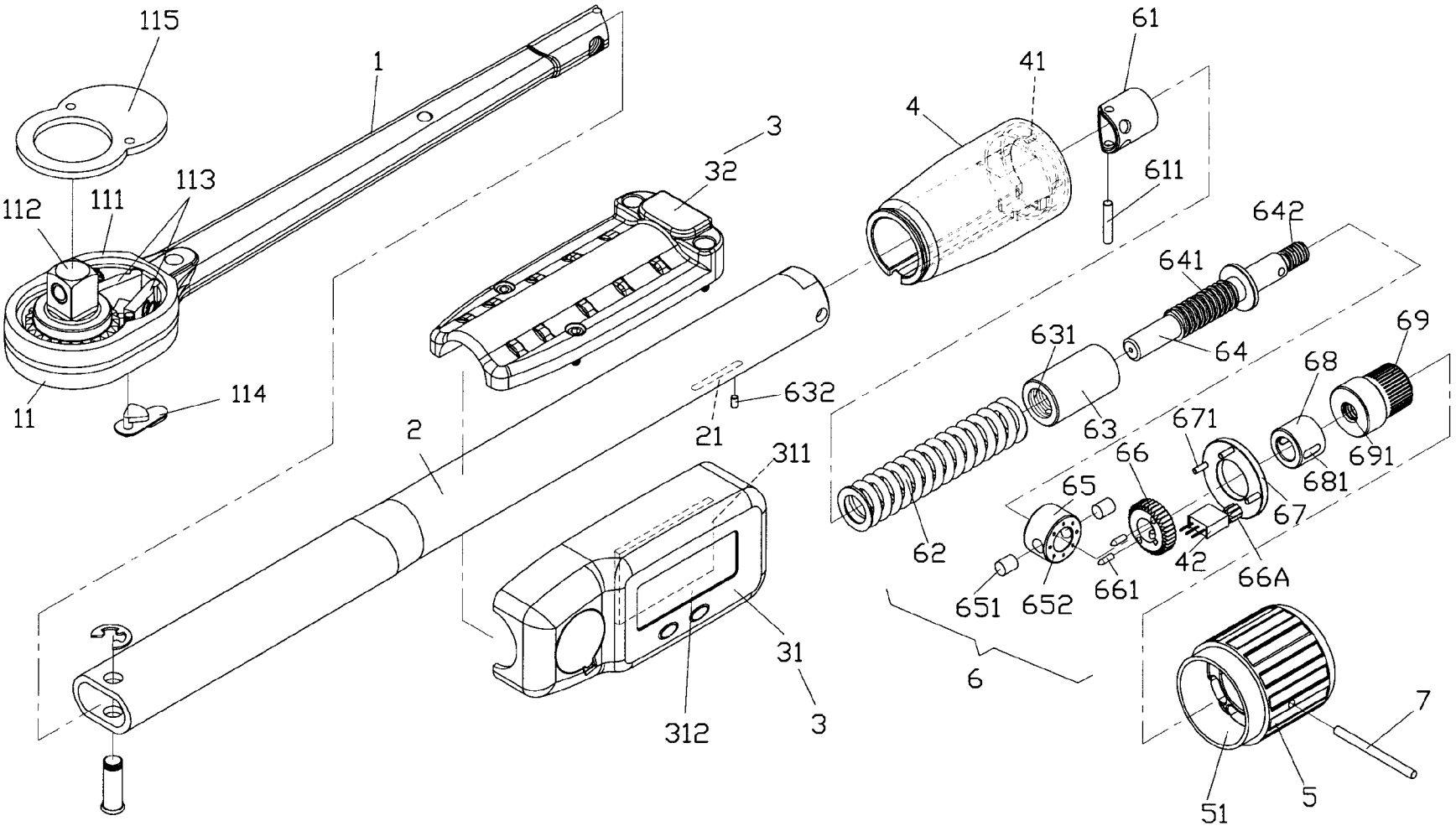
FIG. 1 is an exploded view to show the electronic torque display unit for wrenches of the present invention.
Figure 2:
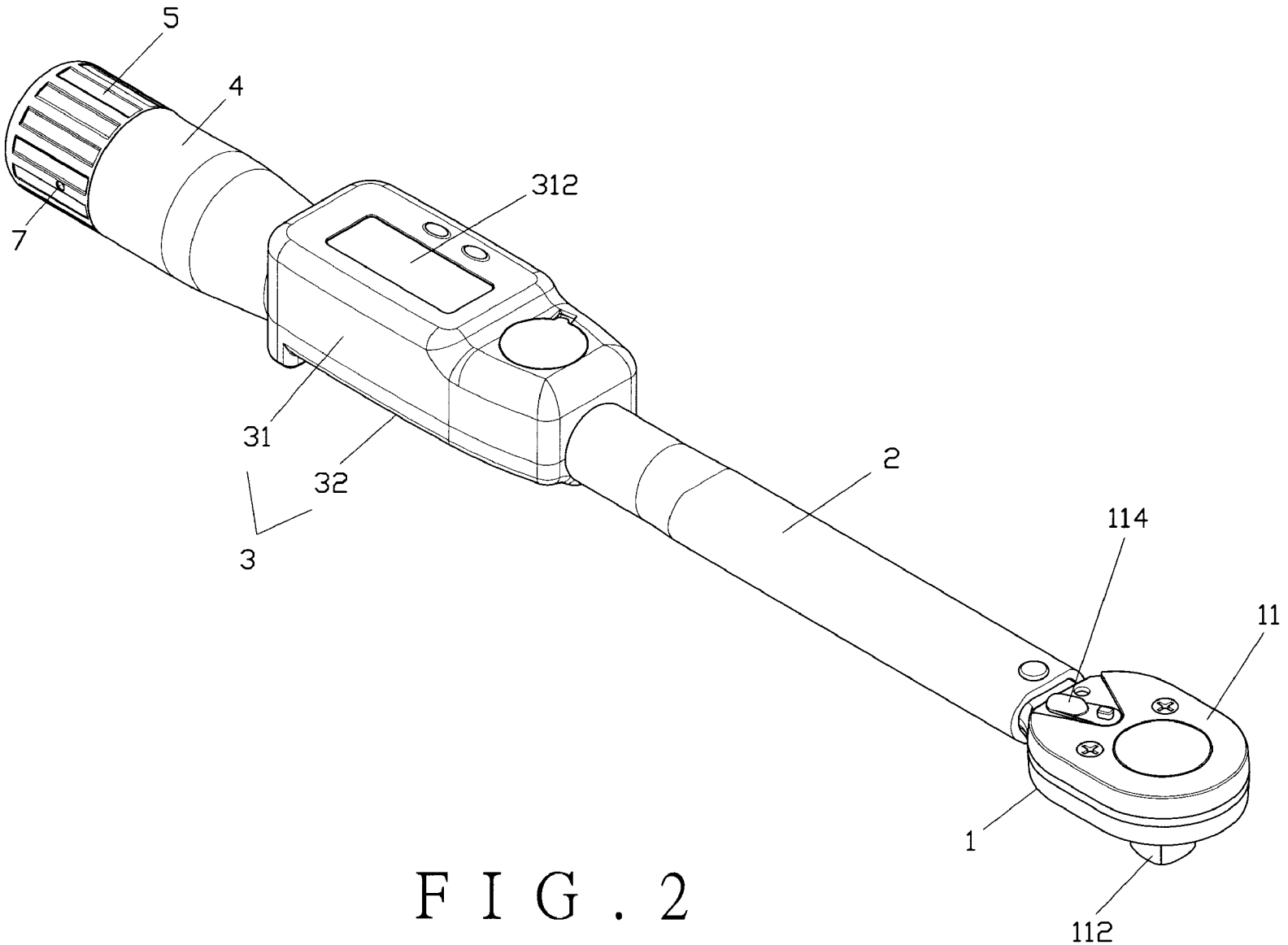
FIG. 2 is a perspective view to show the wrench with the electronic torque display unit of the present invention.
Figure 3:
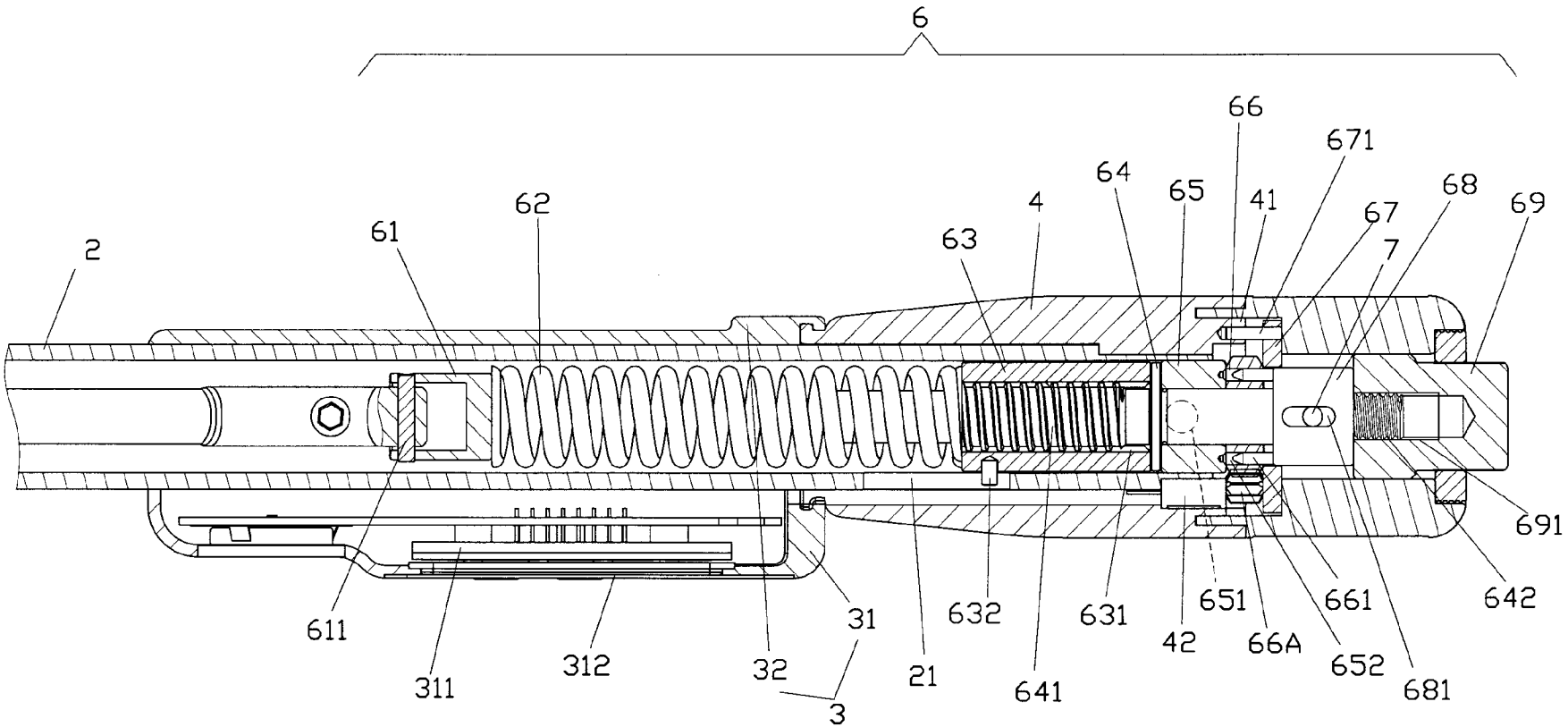
FIG. 3 is a cross sectional view to show the electronic torque display unit of the present invention, wherein the positioning cap is located at a position where the movable tube is not yet pushed by the rod.

Referring to FIGS. 1 to 3, a preferred embodiment of the present invention comprises a shank 1, a hollow and elongate case 2, an electronic display unit 3, sleeve 4, a handle 5, a torque unit 6, and a long pin 7.

The shank 1 has a first end and an opposite second end. A driving head 11 is disposed at the first end of the shank 1, and a ratchet member 112 is received in a recess 111 defined in the driving head 11. Two pawls 113 are pivotally engaged with the ratchet member 112 and a switch lever 114 is connected with the pawls 113 so as to change effective direction that the ratchet head 11 is allowed to rotate. A cover 115 is disposed on the driving head 11 and closes the recess 111.

The case 2 is fixedly connected to the shank 1, and has a first end and a second end. The second end of the case 2 includes a first slot 21 defined axially through a wall thereof.

The electronic display unit 3 is connected to the case 2 and includes a first part 31 and a second part 32. The first part 31 has a circuit board 311 and a display screen 312. The circuit board 311 detects the value that the pre-set torque is set and the display screen 312 shows the value of the torque.

The sleeve 4 is a hollow member, and has a first end fixed to the second end of the case 2 and a second end connected to the handle 5. A plurality of notches 41 are defined in the second end of the sleeve 4. Variable resistors 42 are provided in the second end of the sleeve 4.

The handle 5 includes a stepped hole 51 defined in an open end thereof.

The torque unit 6 is received in the case 2 and the sleeve 4, and includes a knocking member 61, a spring 62, a movable tube 63, a rod 64, a push member 65, a first gear 66, a second gear 66A which has less number of teeth than that of the first gear 66, a disk 67, a collar 68 and a positioning cap 69. The knocking member 61 has a pin 611 which connects the knocking member 61 to the second end of the shank 1. The movable tube 63 has first inner threads 631 defined therein, and a guide pin 632 extends through the first slot 21 in the case 2 and guides movement of the movable tube 63. The rod 64 has a first end and a second end. The first end of the rod 64 includes first outer threads 641 and the second end of the rod 64 includes second outer threads 642. The first outer threads 641 are engaged with the first inner threads 631 in the movable tube 63. The push member 65 includes two side pins 651 connected thereto such that the push member 65 is fixed to the second end of the case 2. The push member 65 includes multiple dimples 652. The first gear 66 is fixed to the rod 64, and multiple positioning pins 661 extend through the first gear 66. The positioning pins 661 are located corresponding in position to the dimples 652. The second gear 66A is engaged with the first gear 66 and pivotally connected with the variable resistors 42 of the sleeve 4. The disk 67 includes engaging pins 67 corresponding in position to the notches 41 in the sleeve 4. One side of the disk 67 engages with the first gear 66, and the other side of the disk 67 engages with the stepped hole 51 in the handle 5. The collar 68 fits onto the second end of the rod 64 and has a second slot 681 defined therethrough in axial direction. The positioning cap 69 includes second inner threads 691 to engage with the second outer threads 642 of the rod 64.

The long pin 7 extends through the handle 5, the collar 68 and the rod 64.

The first gear 66 drives the second gear 66A which is connected with the variable resistors 42. The variable resistors 42 are electrically connected with the electronic display unit 3.

The wrench comprises a positioning arrangement which includes the second outer threads 642 provided on the second end of the rod 64, the push member 65, the first gear 66 and the collar 68 fitted onto the rod 64 and the positioning cap 69 threadedly connected to the second outer threads 642 with the second inner threads 691 in the positioning cap 69. The positioning pins 661 are removably engaged with the dimples 652. When the circuit board 311 detects the output torque of the wrench reaches the pre-set value of the torque, the positioning arrangement locks the handle 5.

As shown in FIG. 3, when using the wrench, the positioning cap 69 is located at a rear position and away from the collar 68, a gap is defined between the positioning cap 69 and the collar 68 so that the collar 68 does not push the two positioning pins 661 which do not engage with the dimples 652 and push against the push member 65. By this arrangement, the handle 5 can drives the first gear 66 to set new torque.

Figure 4:
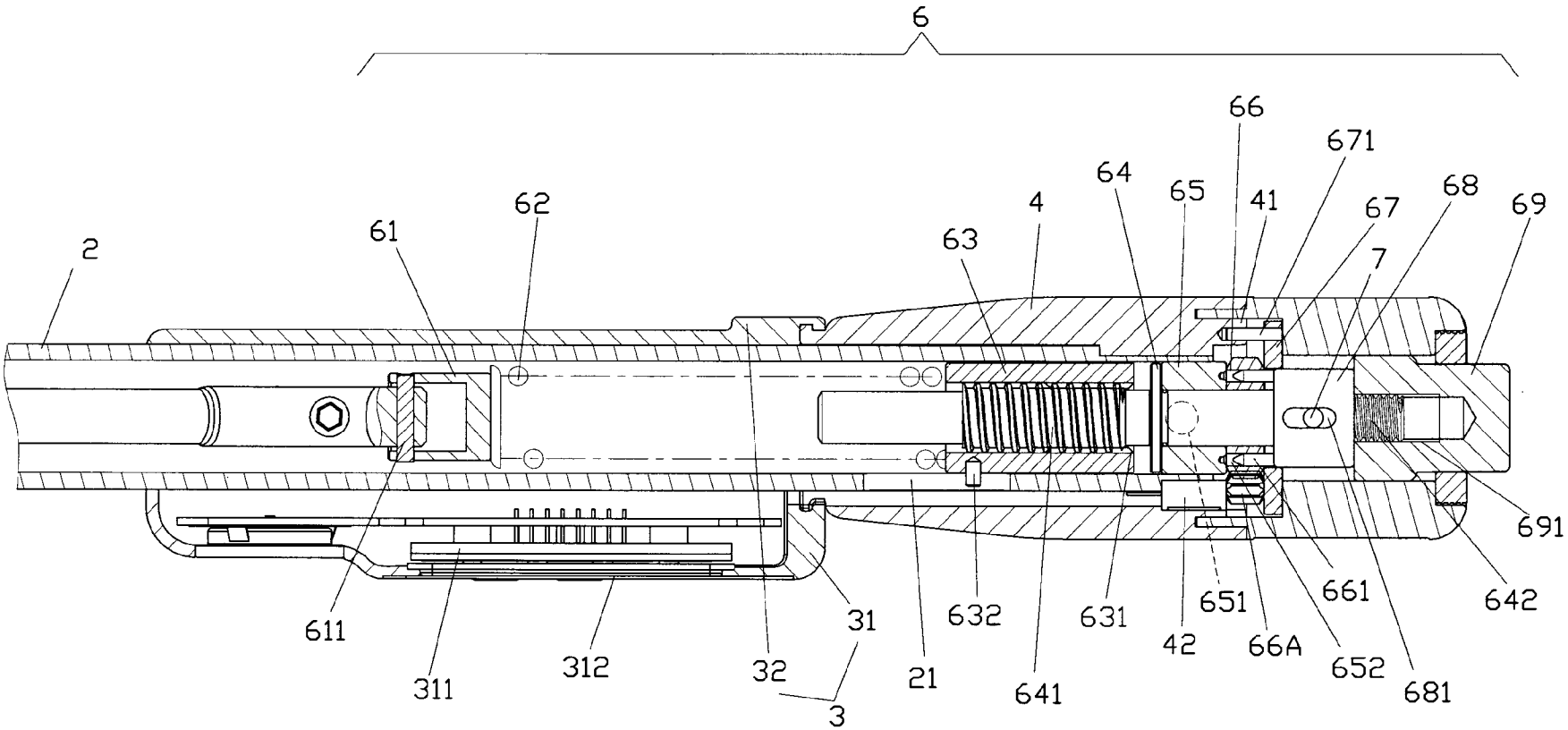
FIG. 4 is a cross sectional view to show the electronic torque display unit of the present invention, wherein the handle is rotated and the movable tube moves toward the spring.

As shown in FIG. 4, when rotating the handle 5, the rod 64 spins and rotates the movable tube 63. The guide pin 632 is movably engaged with the first slot 21 so that the movable tube 63 moves axially and linearly. The spring 62 is then compressed by the movable tube 63.

Figure 5:
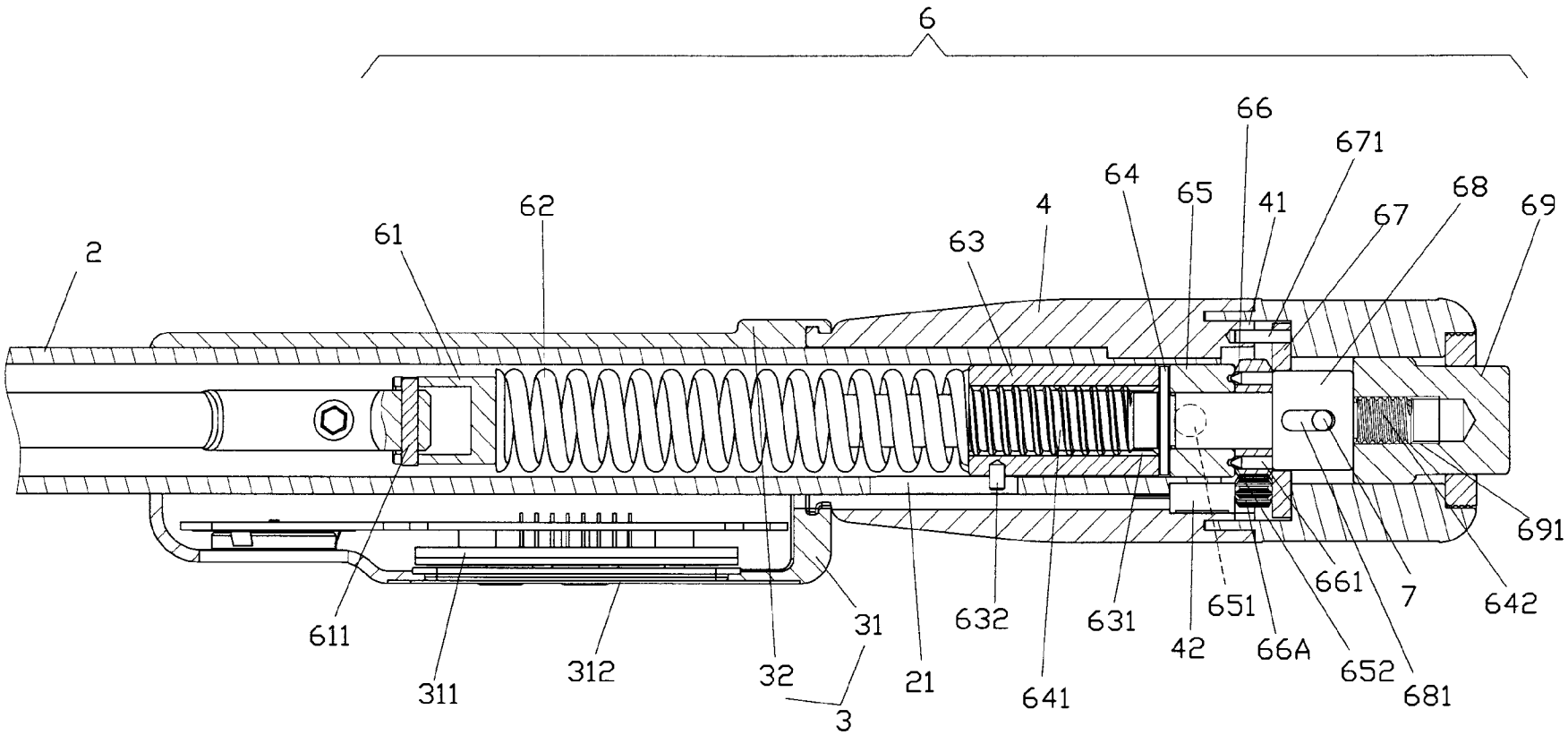
FIG. 5 is a cross sectional view to show the electronic torque display unit, when the circuit board detects the torque reaches the pre-set value, the positioning cap is rotated to engage the positioning pins with the dimples and the handle is locked and cannot be rotated.

As shown in FIG. 5, when the circuit board 311 detects that the torque output reaches the pre-set value of the torque, the positioning cap 69 is then rotated toward the collar 68 which urges the two positioning pins 661 of the first gear 66 to engage with the dimples 652 and secure the first gear 66. By this arrangement, the handle 5 cannot be rotated so as to set the value. When the driving head 11 reaches the pre-set value of the torque, the knocking member 61 is disengaged from the shank 1 and generates a sound to acknowledge the user that the pre-set torque is reached.

When the wrench is not in use, the handle 5 should be rotated to a position where the spring 62 is not compressed such that the spring 62 can be used for a longer period.

Figure 6:
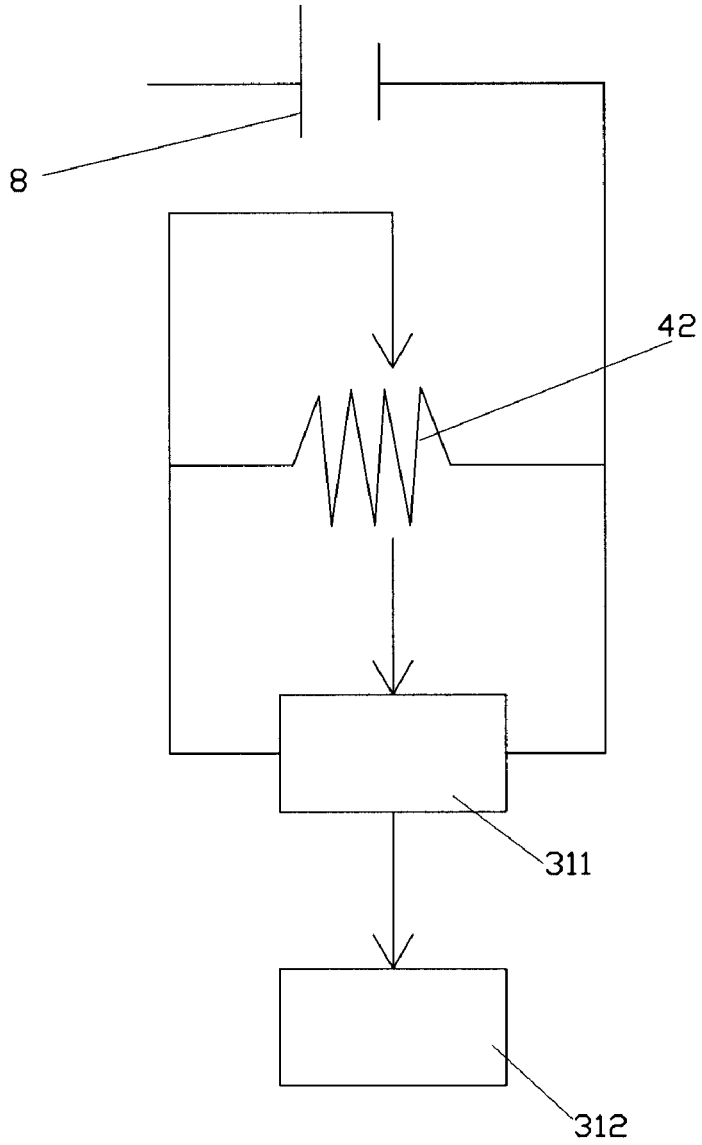
FIG. 6 is a diagram to show the circuit used in the electronic torque display unit of the present invention.
Figure 7:
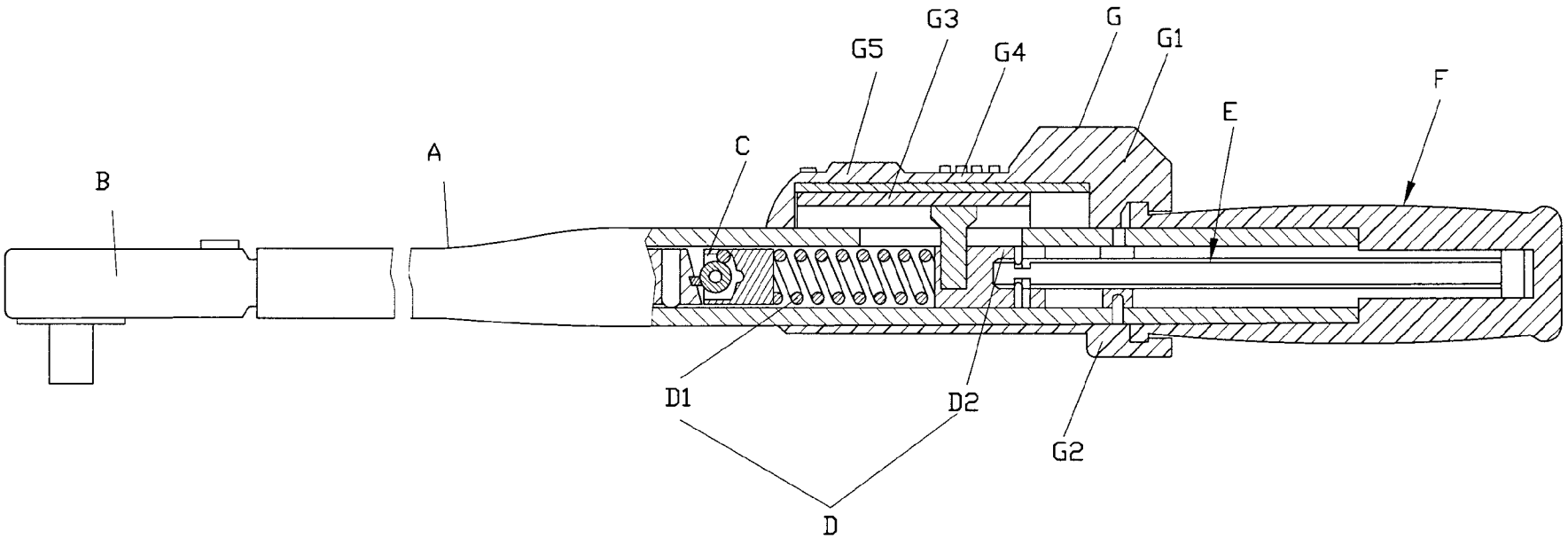
FIG. 7 (PRIOR ART)
FIG. 7 shows a cross sectional view of a conventional electronic torque display unit.
Figure 8:
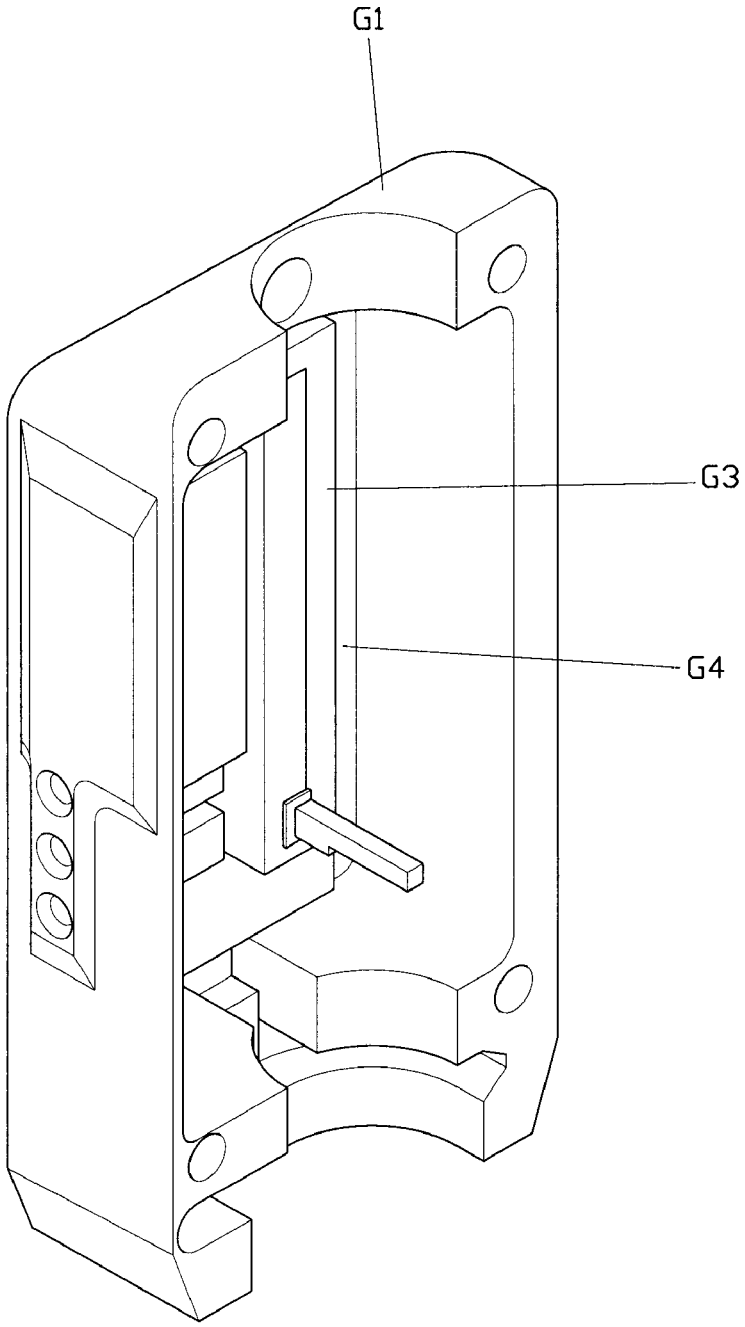
F I G . 8 (PRIOR ART)
FIG. 8 shows the body of the conventional torque detection unit.

As shown in FIG. 6 which shows that the electronic torque display unit is operated by a direct current source 8, wherein the first gear 66 drives the second gear 66A by rotating the handle 5. The second gear 66A is engaged with the variable resistors 42 of the sleeve 4. The variable resistors 42 are controlled by the number of the revolutions of the second gear 66A. The circuit board 311 detects the value of the resistance and is electrically connected with the electronic display unit 3 so that the value of the torque is displayed on the display screen 312.

The variable resistors 42 output analog signals which are converted into digital signals via the circuit board 311 and the digital signals are displayed in the display screen 312.

While we have shown and described the embodiment in accordance with the present invention, it should be clear to those skilled in the art that further embodiments may be made without departing from the scope of the present invention.

What is claimed is:

1. A wrench comprising:

a shank having a driving head connected to a first end of the shank and a ratchet member received in a recess defined in the driving head, two pawls pivotally engaged with the ratchet member and a switch lever connected with the pawls, a cover disposed on the driving head and closing the recess;

a case fixedly connected to the shank and having a first end into which the shank is inserted and a second end which includes a first slot defined axially through a wall thereof;

an electronic display unit connected to the case and including a first part and a second part, the first part having a circuit board and a display screen;

a sleeve being a hollow member and having a first end thereof fixed to the second end of the case, a second end of the sleeve pivotally connected to a handle, the handle including a stepped hole defined in an open end thereof and a plurality of notches defined in the second end of the sleeve, variable resistors provided in the second end of the sleeve;

a torque unit received in the case and the sleeve, the torque unit including a knocking member, a spring, a movable tube, a rod, a first gear, a second gear which has less number of teeth than that of the first gear, and a disk, the movable tube having first inner threads defined therein and a guide pin extending through the first slot in the case and guiding movement of the movable tube, the rod having a first end and a second end, the first end of the rod including first outer threads which are threadedly engaged with the first inner threads in the movable tube, the first gear fixed to the rod and the second gear engaged with the first gear and engaged with the variable resistors, the disk including engaging pins corresponding in position to the notches in the sleeve, and a pin extending through the handle and the rod.

2. The wrench as claimed in claim 1, wherein the first gear drives the second gear which is connected with the variable resistors, and the variable resistors are electrically connected with the electronic display unit.

3. The wrench as claimed in claim 1 further comprising a positioning arrangement which includes second outer threads formed on the second end of the rod, a push member, the first gear and a collar fitted onto the rod and a positioning cap threadedly connected to the second outer threads with second inner threads defined in the positioning cap, the push member including dimples and a plurality of positioning pins connected to the first gear, the positioning pins being removably engaged with the dimples, the collar including a second slot.

4. The wrench as claimed in claim 1, the variable resistors output analog signals which are converted into digital signals via the circuit board and the digital signals are displayed in the display screen.

* * * * *